US007516860B1

(12) United States Patent
Fenton et al.

(10) Patent No.: US 7,516,860 B1
(45) Date of Patent: Apr. 14, 2009

(54) INTERLOCKING BOTTLE CONFIGURATION

(75) Inventors: Russell Rowan Fenton, Williamsville, NY (US); Elmer (Chuck) H. Goss, East Amherst, NY (US); John Scott Jones, Eggertsville, NY (US)

(73) Assignee: Kranson Industries, Inc., St. Louis, MO (US)

( * ) Notice: Subject to any disclaimer, the term of this patent is extended or adjusted under 35 U.S.C. 154(b) by 479 days.

(21) Appl. No.: 10/770,555

(22) Filed: Feb. 3, 2004

(51) Int. Cl.
*B65D 21/032* (2006.01)

(52) U.S. Cl. ..... 215/6; 215/10

(58) Field of Classification Search ..... None
See application file for complete search history.

(56) References Cited

U.S. PATENT DOCUMENTS 3,750,890 A * 8/1973 Smith et al. ..... 211/75
3,889,834 A * 6/1975 Harris, Jr. ..... 215/10
3,994,408 A * 11/1976 Belitzky ..... 215/10
4,381,841 A 5/1983 Schwarz
5,316,159 A 5/1994 Douglas et al.
D439,156 S 3/2001 Hall et al.
6,276,550 B1 * 8/2001 Cherrington ..... 220/23.4
2001/0030191 A1 10/2001 Bopp, III et al.

* cited by examiner

*Primary Examiner*—Stephen J. Castellano
(74) *Attorney, Agent, or Firm*—H. Frederick Rusche; Husch Blackwell Sanders LLP

(57) ABSTRACT

An interlocking engagement for plastic containers in which a pair of identically formed bottles can be removably secured to one another along identical configured effacing surfaces. The bottle has oppositely disposed male and female configurations that upon effacing co-planar trans-lateral engagement with one another from an identical bottle surface engagement lock together forming a dual chambered integral container with multiple independent access closure openings therein.

9 Claims, 4 Drawing Sheets

INTERLOCKING BOTTLE CONFIGURATION

BACKGROUND OF THE INVENTION

1. Technical Field

This invention relates to liquid containers that can be selectively secured together by the engagement of interlocking contoured surfaces. Such containers are typically used to hold two different products within a single transportable container configuration. Such containers utilize two separate enclosures which are joined together by a variety of means.

2. Description of Prior Art

Prior art devices of this type have relied on a variety of different multiple bottle configurations having different inter-engageable surface formations thereon, see for example U.S. Pat. Nos. 4,381,841, 5,316,159, D439,156 and Patent Publication US2001/0030191 A1.

In U.S. Pat. No. 4,381,841 an interlocking arrangement for plastic containers can be seen in which a triad of containers are disclosed having a large central container onto which a pair of identical smaller containers are interlocked thereto.

U.S. Pat. No. 5,316,159 discloses a dual bottle container in which a pair of differently configured bottles are shown to be interlocked to one another by inner engaging "key" elements defined by corresponding groove and flange configurations oriented vertically therebetween.

U.S. Pat. No. D439,156 is drawn to a set of interlocking bottles, each having an elongated groove and spaced parallel rib on their respective side surfaces. The bottles are secured to one another by longitudinal vertical engagement.

Interlocking separable containers are shown is patent Publication 2001/0030191 A1 having a main upstanding bottle with contoured upper side portions and a registration key formed therein. A corresponding smaller container with a receiving opening therethrough is slidably disposed thereon.

SUMMARY OF THE INVENTION

A bottle container of the present invention has a dual interlocking system that permits it to be inter-engaged with a second identical bottle container to form a dual bottle container configuration. The bottle container has an attachment wall surface with a contoured recess portion and a spaced horizontally aligned is interlocking protrusion which has a right angled sidewall in oppositely disposed angled adjoining surface for registration with the corresponding inner walls of the recessed portion.

DESCRIPTION OF THE PREFERRED EMBODIMENT

Figure 1:
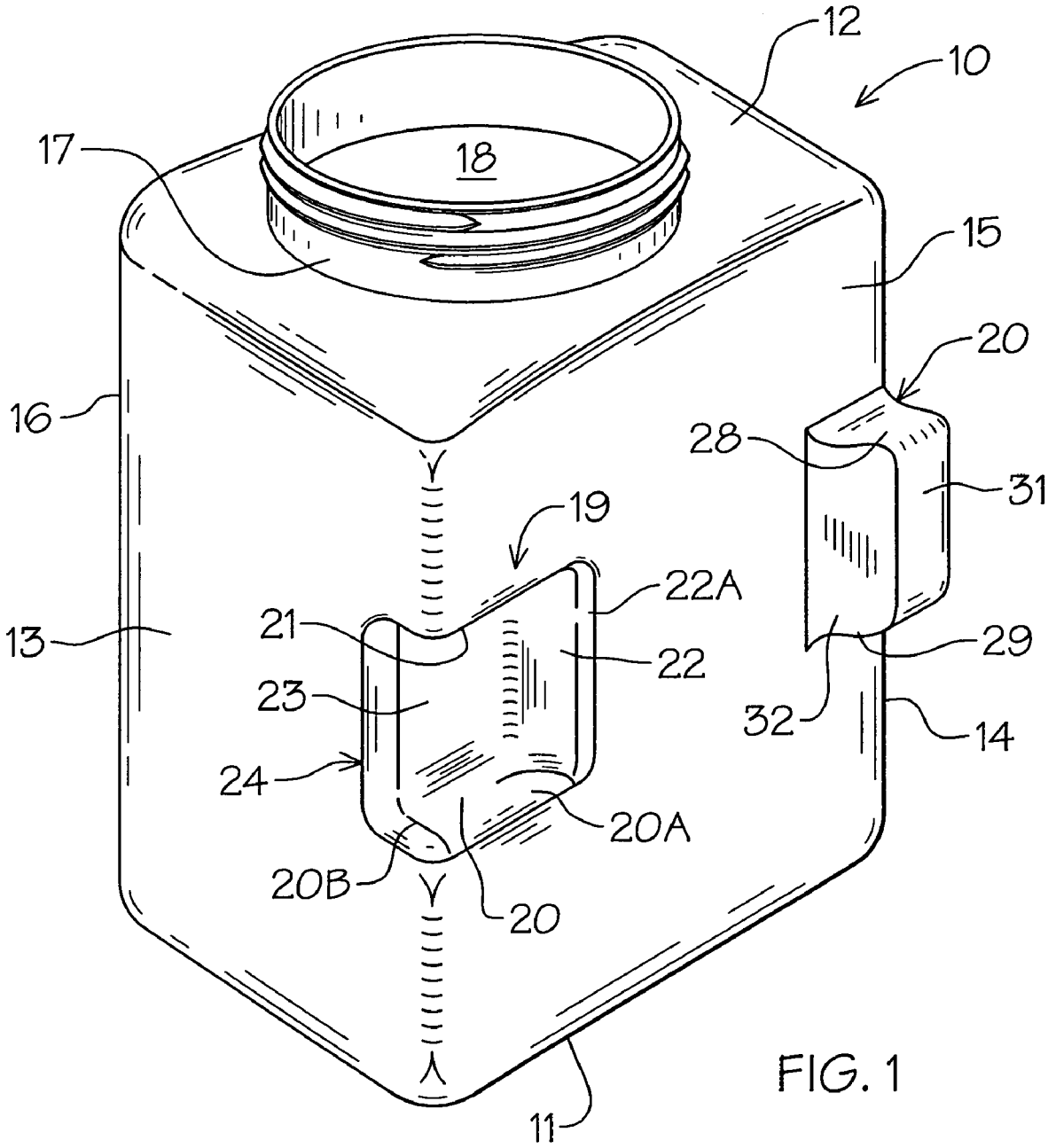
FIG. 1 is a perspective view of the bottle container of the invention.
Figure 2:
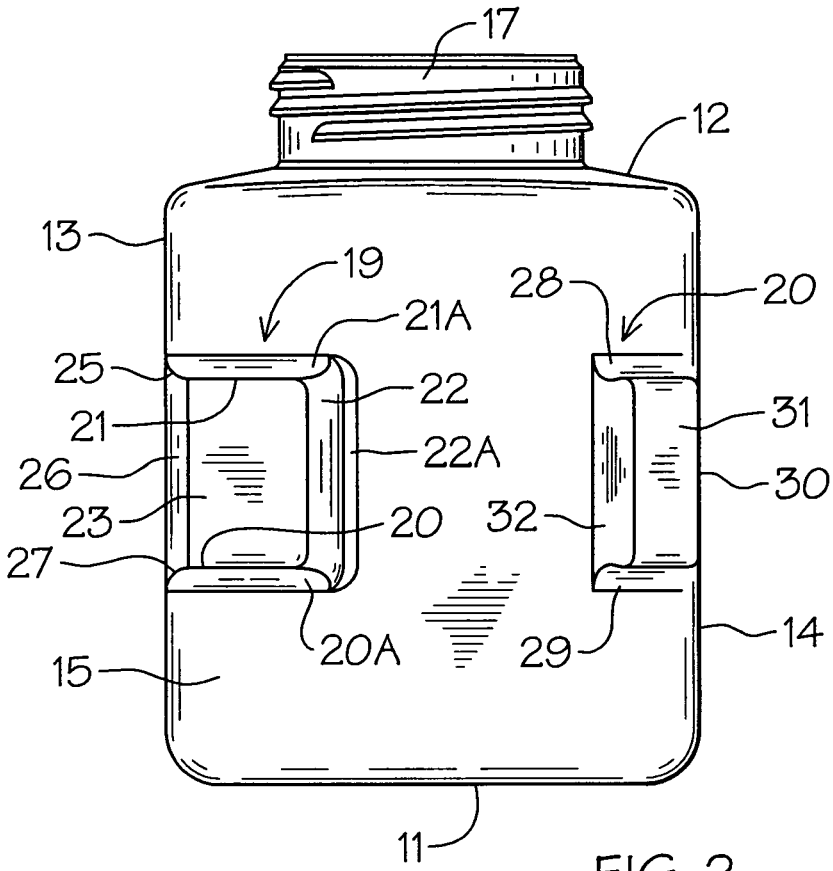
FIG. 2 is a front elevational view of the interlocking wall surface.
Figure 3:
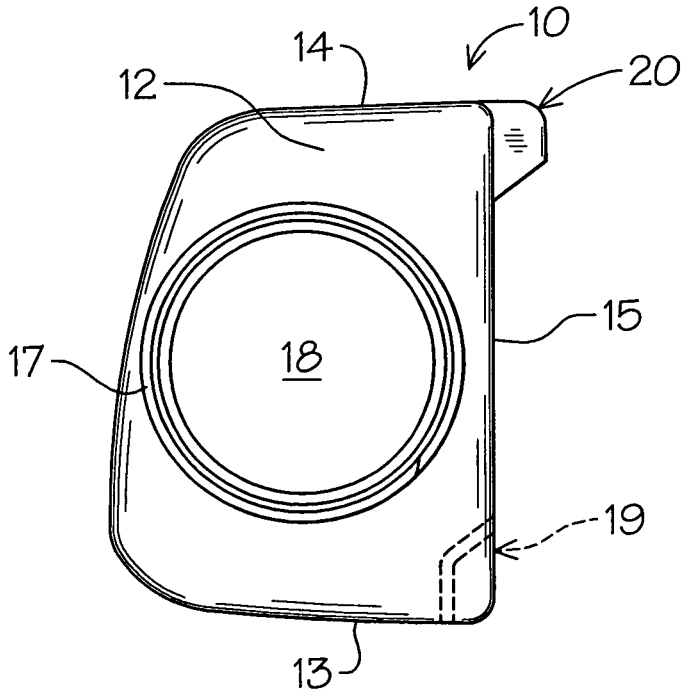
FIG. 3 is a top plan view thereof.

Referring to FIGS. 1, 2 and 3 of the drawings, a bottle container 10 of the invention can be seen having a bottom wall

Figure 4:
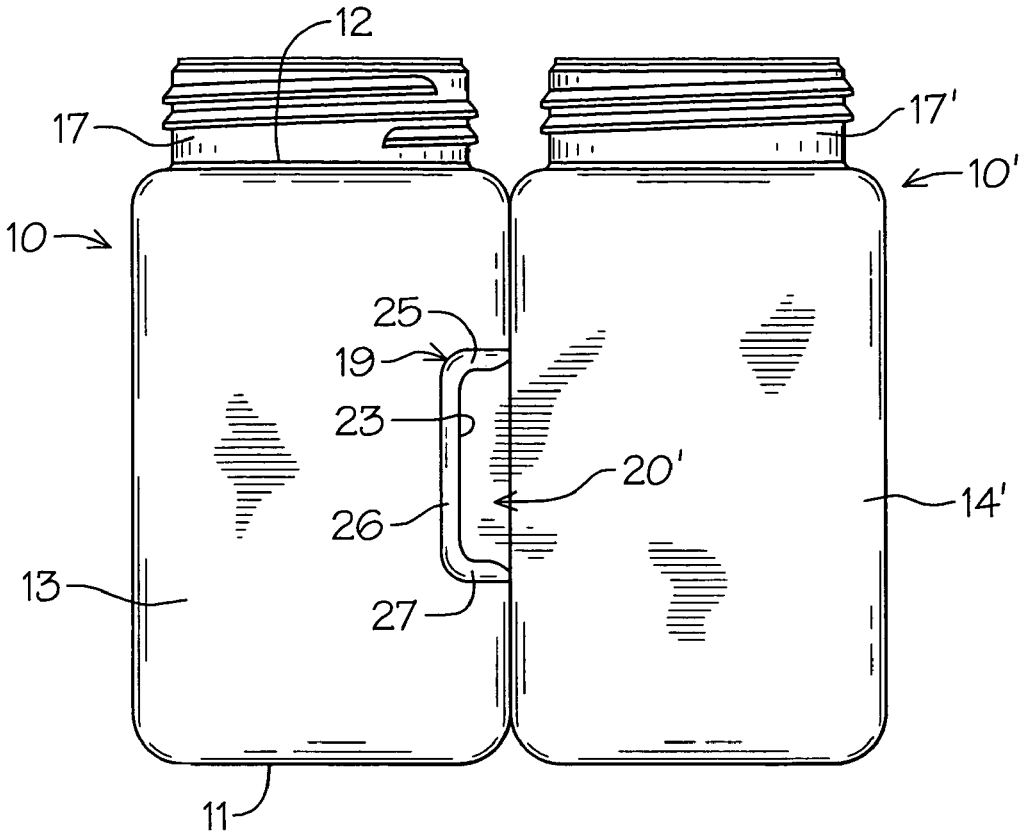
FIG. 4 is a front elevational view of a pair of containers joined together.
Figure 5:
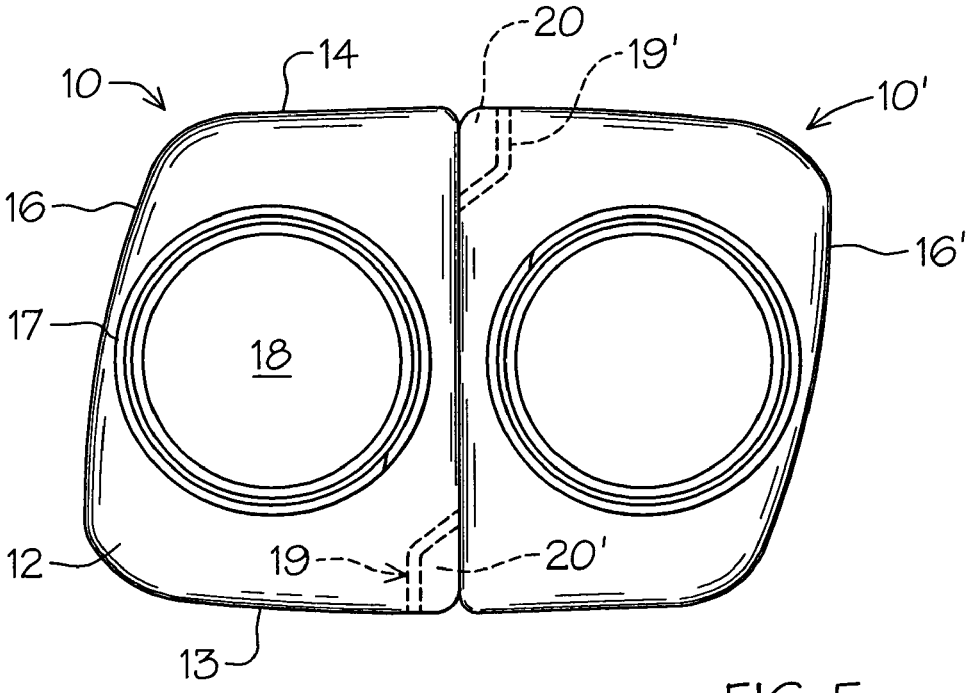
FIG. 5 is a top plan view thereof.
Figure 6:
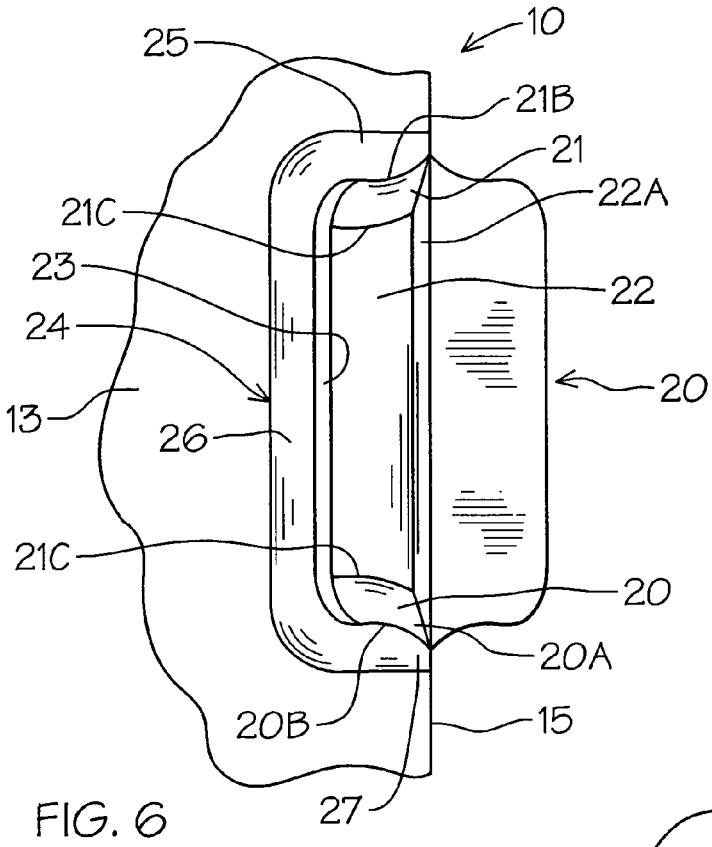
FIG. 6 is an enlarged front elevational view of the recess locking portion thereof.
Figure 7:
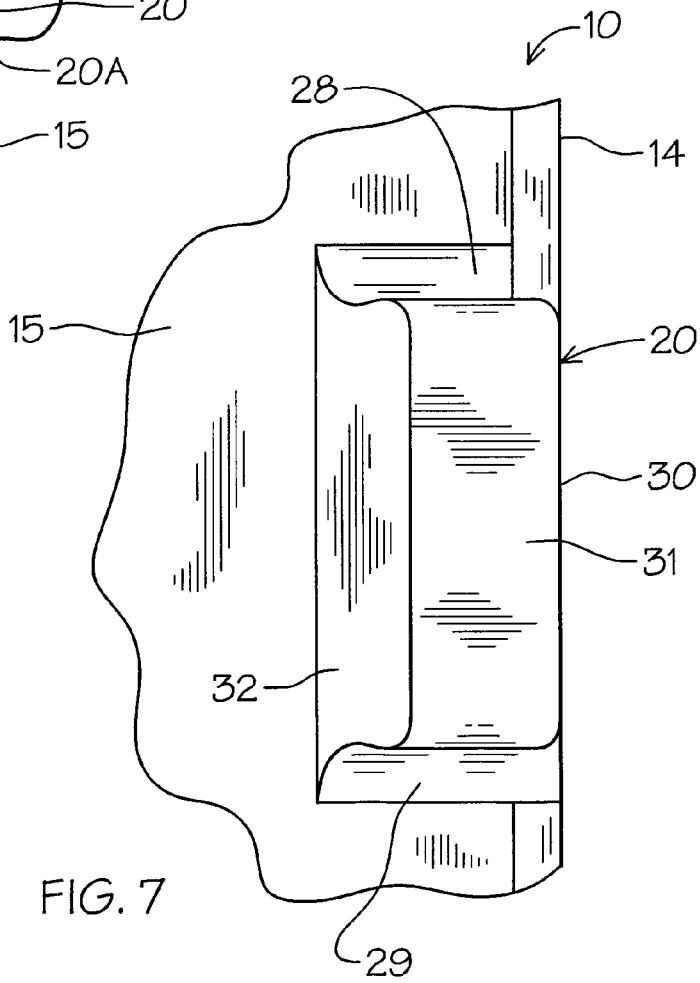
FIG. 7 is an enlarged side elevational view of the locking lug of the invention.

11, a top wall 12 with an integral front wall 13, back wall 14 and oppositely disposed sidewalls 15 and 16 therebetween. A threaded neck 17 extends from the top wall 12 defining an access opening at 18 within. The sidewall 15 has a locking engagement recess portion 19 intersecting the corner junction of the respective sidewall 15 and front wall 13. A co-registration locking lug 20 of the invention extends from the sidewall 15 for transversely interlocking a pair of identical bottle containers 10 together within respective recessed portions 19 in a predetermined sidewall to sidewall orientation as seen in FIGS. 4 and 5 of the drawings.

The recessed portion 19 has a contoured base surface 20 with a transversely arcuate transition side lip portion 20A extending inwardly from the planar surface of the sidewall 15. An oppositely disposed contoured inner top surface 21 of the recessed portion 19 has a corresponding upper transversely arcuate transition side lip portion 21A extending inwardly from the planar surface of the side 15.

An end inner wall surface 22 of the recess 19 extends between the respective base and inner top surfaces 20 and 21 respectively with an inner end wall arcuate transition lip 22A. The end inner wall surface 22 is angularly disposed inwardly from the planar surface 15 as seen in FIG. 3 of the drawings. The respective inner base and inner top portions 20 and 21 are tapered longitudinally from their respective intersections at 20B and 21B outwardly to the end inner wall junction at 20C and 21C respectively and angularly disposed along their respective horizontal planes towards one another from intersections at 20B and 21B.

It will be seen therefore that a back inner wall surface 23 of the recess portion 19 has a divergent planar surface of reduced dimensional area to that of the recess opening 19 defined within the side surface 15.

Correspondingly, a recess end portion at 24 within the front wall surface 13 of the hereinbefore described recess 19 is defined by multiple arcuate lip portions 25, 26 and 27 of the hereinbefore described respective inner base, top and back surface, 20, 21 and 23.

The locking lug 20, best seen in FIGS. 2, 3, 7, and 8 of the drawings has contoured upper and lower engagement surfaces 28 and 29 with an outside adjoining side surface 30 co-planar with the bottle container's back wall 14. An upstanding front surface 31 extends from the respective upper and lower engagement surfaces 28 and 29 and side surface 30. An inside side surface 32 extends angularly from the sidewall 15 intersecting the respective hereinbefore described upper and lower front surfaces 28, 29, and 31 respectively.

It will be seen that for interlocking registration, that when the locking lug 20 and the bottle container 10 is slidably disposed within a recessed area 19' of an identical adjoining bottle container 10' as illustrated in FIGS. 4 and 5 of the drawings, that the locking lug 20 oppositely disposed upper and lower engagement surfaces 28 and 29 have a one degree longitudinal draft therebetween to afford interlocking registration. Therefore as the lugs 20 of the respective containers 10 and 10' are longitudinally engaged within their corresponding contoured recesses 19 and 19' that the registration of the contoured upper and lower lug surfaces 28 and 29 with the tapered inner base and top surfaces 20 and 21 and lugs front surface 31 against the angular disposed interlocking surface 23 of the recess 19 and 19' an interlocking interference fit is achieved aided by the material properties of the containers themselves for yieldable registration as will be well understood by those skilled in the art.

This precise arrangement of the lugs 20 and 20' within the respective recess areas 19 and 19' engagement surfaces as hereinbefore described allows for a pair of identical bottle containers 10 and 10' (for illustration purposes) of the invention to the interengaged and locked together by the respective effacing sidewalls 15 under trans-lateral sliding registration engagement indicated in broken lines in FIG. 5 of the drawings.

It will be evident that such containers having the interlocking features of the present invention can be removably secured to one another allowing, if required, selective disengagement therefrom.

It will be evident to those skilled in the art that various changes and modifications may be made therein without departing from the spirit of the invention and therefore we claim:

1. A modular molded bottle container comprising, a top and bottom with integral walls therebetween, wherein the integral walls include a front wall, a rear wall opposite said front wall, and a first and second oppositely disposed side walls extending between said front and rear wall, said front wall of said integral walls being generally flat and planar and having interengagement portions thereon for selective locking registration with identical interengagement portions of a second identical container, the remaining portion of said generally flat and planar front wall lying in a single plane, said interengagement portions comprising a male lug portion and a female recess portion, said female recess portion extends into said first side wall adjacent said front wall, said male portion in a planar relationship with said second side wall adjacent said front wall, said female recess portion having contoured surfaces capable of coinciding substantially with the contour of a male portion of a second identical container when the two containers are positioned with their respective front walls in an abutting relationship, said contoured surfaces of said female recess portion comprising a generally planar and vertical inner end wall extending inwardly at an angle greater than ninety degrees from said front wall and a generally planar inner back wall surface, said contoured surfaces of said female recess portion further comprising an elongated longitudinally contoured tapered inner base surface having a lower arcuate lip portion extending inwardly from said front wall, and an elongated longitudinally contoured tapered inner top surface having an upper arcuate lip portion extending inwardly from said front wall;

said contour of said male portion comprising a generally planar front surface and a generally planar and vertical inside surface extending outwardly at an angle greater than ninety degrees from said front wall, and said male portion further comprising oppositely disposed colateral longitudinally contoured elongated upper and lower engagement surfaces extending between said generally planar front surface and said front wall, said male portion further comprising a vertical outside surface extending in the same plane as said second side wall of said container, and wherein said container is adapted to engage a second identical container, wherein the following conditions are met when said container is in abutting contact with the second identical container:

a. said male lug portion angularly disposed vertical inside surface of said container abuts said angularly disposed inner end wall of said female recess portion of the second identical container, b. said male lug portion upper engagement surface abuts said upper arcuate lip portion of said female recess portion, c. said male lug portion lower engagement surface abuts said lower arcuate lip portion of said female recess portion, and wherein d. said vertical outside surface of said male portion of said container is positioned in the same plane as said first side wall of said second identical container to provide visual confirmation of said male portion positioned within said female portion when viewed from one of said first side of said container and said second side of said container.

2. The modular molded bottle container set forth in claim 1 wherein said inner base and top surfaces and said inner end wall surface intersect the plane of said front wall.

3. The modular molded bottle container set forth in claim 1 wherein said front surface of said male lug portion is of a known surface dimension less than that of said inner back wall surface of said female recess portion.

4. A modular molded container system comprising a pair of identical bottle containers of predetermined volume, each of said bottles having a top and bottom with multiple adjoining integral walls therebetween, wherein the integral walls include a front wall, a rear wall opposite said front wall, and a first and second oppositely disposed side walls extending between said front and rear wall, wherein said front wall is generally flat and planar, a neck portion extending from said top defining an opening therein, a generally flat planar surface on said front wall having interengagement portions thereon with the remainder of said front wall lying in a single plane, said interengagement portions comprising, a recessed receiving portion and a lug insert portion in spaced aligned horizontal relation to one another, said recessed receiving portion extending inwardly from the planar surface of said front wall and extending into said first side wall adjacent said front wall, said recessed receiving portion having longitudinally contoured tapered base and inner top surfaces, wherein said tapered base includes a lower lip portion extending inwardly from said planar surface of said front wall and said inner top surface includes an upper lip portion extending inwardly from said planar surface of said front wall, said lug insert portion having longitudinally contoured upper and lower engagement surfaces for co-lateral registration within said upper and lower lip portions of the other identical bottle container, and an outside engagement side surface extending in the same plane as said second side wall and an inner engagement side surface being planar and extending outwardly at an angle greater than ninety degrees from said flat planar surface of said front wall, said recessed receiving portion having a planar end inner wall extending inwardly at an angle greater than ninety degrees from said planar surface of said front wall for registration with the corresponding angularly disposed inner engagement side surface of said lug insert of an identical bottle container, such that said outside engagement side surface of said lug insert portion is positioned in the same plane as said first side wall of an identical bottle container to provide visual confirmation of said lug insert portion positioned within said recessed receiving portion of an identical bottle container when viewed from one of said first side and said second side of each container.

5. The modular molded bottle of claim 4 wherein said recessed receiving portion has a wall surface extending from said end inner wall outwardly from an adjacent adjoining integral wall and is of a divergent planar surface of reduced dimensional area.

6. The modular molded bottle of claim 4 wherein said recessed receiving portion comprises an inner back wall surface extending between said base and inner top surfaces, wherein said base and inner top surfaces and said inner back wall surface of said recessed receiving portion intersect the plane of said first side wall.

7. The modular molded bottle container set forth in claim 6 wherein said lug insert portion comprises a front surface extending between said upper and lower engagement surfaces, said front surface of said male lug portion is of a known surface dimension less than that of said inner back wall surface of said female recess portion.

8. The modular molded bottle of claim 5 wherein said base and inner top surfaces and said wall surface extending from said inner back wall surface of said recessed receiving portion intersect the plane of said first side wall.

9. A modular molded bottle container comprising, a top and bottom and a plurality of walls therebetween, said plurality of walls comprising a front wall having interengagement portions thereon for locking with identical interengagement portions of a second identical container, said interengagement portions comprising a male portion and a female portion, said male portion extending from said front wall and having an outside surface extending in the same plane as a first side wall of said container adjacent said front wall, and said female portion extending into said front wall and further extending into a second side wall of said container that is adjacent said front wall and opposite said first side wall, said male portion configured to lock with a female portion of a second identical container, and said female portion configured to lock with a male portion of the second identical container, said male portion having contoured surfaces, said female portion having contoured surfaces that coincide with said contoured surfaces of said of said male portion of a second identical container when said container is locked with the second identical container, said contoured surfaces of said female portion comprising an inner end wall that extends inwardly into said front wall at an angle greater than ninety degrees, said contoured surfaces of said male portion comprising a vertical inside surface that extends outwardly from said front wall at an angle greater than ninety degrees, and wherein when said container is adapted to be locked with a second identical container, the following condition is met: said male portion vertical inside side surface abuts said female portion inner end wall and said vertical outside surface of said male portion is positioned in the same plane as said second side wall of the second identical container to provide visual confirmation of said male portion positioned within said female portion when viewed from one of said first side wall and a second side wall of said container.

* * * * *